US007884555B2

(12) United States Patent
Nukisato et al.

(10) Patent No.: US 7,884,555 B2
(45) Date of Patent: Feb. 8, 2011

(54) DISCHARGE LAMP BALLAST APPARATUS

(75) Inventors: Yasuhiro Nukisato, Tokyo (JP); Takashi Ohsawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 369 days.

(21) Appl. No.: 12/162,738

(22) PCT Filed: Feb. 9, 2007

(86) PCT No.: PCT/JP2007/052379

§ 371 (c)(1),
(2), (4) Date: Jul. 30, 2008

(87) PCT Pub. No.: WO2007/129490

PCT Pub. Date: Nov. 15, 2007

(65) Prior Publication Data

US 2009/0009098 A1 Jan. 8, 2009

(30) Foreign Application Priority Data

May 1, 2006 (JP) ..... 2006-127686

(51) Int. Cl.
*H05B 37/02* (2006.01)

(52) U.S. Cl. ..... 315/223; 315/82; 315/224; 315/291

(58) Field of Classification Search ..... 315/77, 315/82, 209 R, 223–226, 283, 287, 291, 307–308; 307/10.1, 10.8

See application file for complete search history.

(56) References Cited

U.S. PATENT DOCUMENTS

| | | | | |
|---|---|---|---|---|
| 4,983,887 | A * | 1/1991 | Nilssen | 315/224 |
| 5,770,925 | A * | 6/1998 | Konopka et al. | 315/225 |
| 5,869,935 | A * | 2/1999 | Sodhi | 315/225 |
| 2002/0125835 | A1 * | 9/2002 | Ito et al. | 315/224 |
| 2002/0140375 | A1 | 10/2002 | Kim et al. | |
| 2003/0062850 | A1 * | 4/2003 | Konopka et al. | 315/224 |

FOREIGN PATENT DOCUMENTS

| | | | |
|---|---|---|---|
| JP | 4-251576 | A | 9/1992 |
| JP | 6-196285 | | 7/1994 |
| JP | 10-41083 | A | 2/1998 |
| JP | 10-321393 | A | 12/1998 |
| JP | 2000-166258 | A | 6/2000 |
| JP | 2002-270388 | A | 9/2002 |
| JP | 2002-330064 | A | 11/2002 |

* cited by examiner

*Primary Examiner*—Douglas W Owens
*Assistant Examiner*—Tung X Le
(74) *Attorney, Agent, or Firm*—Birch, Stewart, Kolasch & Birch, LLP

(57) ABSTRACT

A capacitor 42 (C1) of a first bootstrap circuit 4 for maintaining the ON state of a first switching device 61, one of the two switching devices disposed on a higher potential side of first DC voltage V1, is not only charged with second DC voltage V2, but also supplied with a charging current from third DC voltage V3 on a secondary winding n2 side of a transformer 22, and maintains the ON state of the first switching device 61 for a long time with the charge of both of them. This makes it possible to fix the polarity of the voltage to be applied to the discharge lamp 8 to the single side polarity closer to the DC output operation.

4 Claims, 3 Drawing Sheets

Control Section
Second Bootstrap Circuit
First Bootstrap Circuit
Igniter
H-bridge-type Inverter
Discharge Lamp Ballast Control Circuit
First DC/DC Converter
Second DC/DC Converter
Constant Voltage Control Circuit
Sc
Sc'
Sa
Sb
V1
V2
V3

DISCHARGE LAMP BALLAST APPARATUS

TECHNICAL FIELD

The present invention relates to a discharge lamp ballast apparatus suitable for lighting a high-intensity discharge lamp without using mercury in particular.

BACKGROUND ART

In vehicles in recent years, headlamps have been spreading which incorporate discharge lamps, that is, high-intensity light sources that give a light field of vision. As for a discharge lamp ballast apparatus for lighting the headlamps incorporating the discharge lamps, miniaturization, efficiency improvement and cost reduction are always required. In addition, exclusion of mercury, which is an environmental load material and a constituent of the discharge lamps, has become a big problem.

Among the discharge lamp ballast apparatuses having these problems, many of the ballast apparatuses used for conventional discharge lamps (referred to as "conventional bulbs" from now on) that emit light with sealing mercury inside in addition to metal iodide (metal halide) such as sodium iodide and scandium iodide are used in such a manner as to set the lighting potential of the discharge lamp at a negative value to reduce devitrification. In contrast to the conventional bulbs, as for discharge lamps without using mercury (referred to as "Hg-free bulbs" from now on) whose discharging voltage during steady-state lighting is halved, ballast apparatuses used for them can halve the effect of the devitrification. Accordingly, the ballast apparatuses need not pay special attention to the lighting potential. Thus, to reduce the size and cost of the components, ballast apparatuses are advantageous which fire discharge lamps using plus potential that enables addition of battery power source voltage to a booster power supply for firing.

The Hg-free bulbs with the foregoing advantage, however, have to pass twice the current of the conventional bulbs during the steady-state lighting, thereby increasing the thickness of the electrodes. In addition, because of the difference in internal materials sealed, the internal gas pressure is higher, the thickness of a glass ball constituting a light-emitting bulb increases, and thermal capacity increases. Therefore, unless greater power is fed to them than to the conventional bulbs during the time from the breakdown at firing the discharge lamp to the start of the steady-state current, not enough heating is given. This increases the probability of ceasing the current on the way from the breakdown to the firing (tiring failure). In such a case, the discharge lamp ballast apparatus must start refiring immediately after the firing failure. In particular, it is necessary for the ballast apparatus for the Hg-free bulb to set the time allowed to repeat the refiring longer than that of the conventional bulb considering the firing failure due to a shortage of heating. It is considered to be a problem peculiar to the ballast apparatus for the Hg-free bulb.

As described above, a variety of problems arise as to the discharge lamp ballast apparatus. As examples of the conventional discharge lamp ballast apparatuses which try to deal with the problems, there are following conventional examples.

As a first conventional example, a circuit configuration is proposed which aims to miniaturize the discharge lamp ballast apparatus with a simple circuit configuration, and drives an H-bridge (H/B) type inverter to light the discharge lamp with negative potential. To operate the switching devices placed in negative potential, a level-shift circuit is provided (see Patent Document 1, for example).

As a second conventional example, an apparatus is proposed which aims at simplification and cost reduction of the circuit configuration of the discharge lamp ballast apparatus, replaces the level-shift circuit of the first conventional example with a bootstrap circuit, and lights the discharge lamp at plus potential (see Patent Document 2, for example).

The foregoing bootstrap circuit charges a capacitor for maintaining the ON state of a switching device placed at the higher potential side of the H-bridge-type inverter when the higher potential side switching device is in the OFF state and a lower potential side switching device connected in series directly thereunder in the bridge connection is in the ON state, and uses the power of the capacitor charged now as a power source for maintaining the ON state of the higher potential side switching device in the next half cycle. This makes it possible to turn on the higher potential side switching devices without continuous power supply from a low potential controlling power source, and to convert a DC (direct current) to an AC (alternating current).

Since the bootstrap circuit is simple and inexpensive, it is an effective driving means of the switching devices of the H-bridge-type inverter serving as an alternating current converting circuit that always alternates polarity.

As a third conventional example, a configuration is proposed which aims to drive the switching devices constituting the H-bridge-type inverter stably, and has a bootstrap circuit with nearly the same configuration as that of the second conventional example. The third conventional example, however, is characterized by using an auxiliary power source to secure a control power source that also serves as the driving power source of the H-bridge-type inverter even at the time when the power source voltage drops (see Patent Document 3, for example).

As a fourth conventional example, an apparatus is proposed which aims at miniaturizing the discharge lamp ballast apparatus, and has a bootstrap circuit in the same manner as the second conventional example or third conventional example. To enable the switching devices placed at the higher potential side to maintain the ON state for a long time, a power source circuit with higher potential than the potential of the switching devices is provided so that the high potential power source supplies a current continuously to capacitors serving as a power source for turning on the higher potential side switching devices (see Patent Document 4, for example).

As a fifth conventional example, a circuit configuration is proposed which aims to start the discharge lamp without fail. It differs from the first to fourth conventional examples in that it drives the H-bridge-type inverter using a transformer (see Patent Document 5, for example).

Although ordinary driving of the switching devices with a transformer cannot continue the ON state of the switching devices for a long time just as an ordinary bootstrap, the fifth conventional example is characterized by enabling them to continue the ON state for a long time by providing each of switching devices at the higher potential side and lower potential side, which pair at passing the current, with an insulated DC power source to supply current to each of them.

Patent Document 1: Japanese Patent Laid-Open No. 10-41083/1998

Patent Document 2: Japanese Patent Laid-Open No. 2000-166258.

Patent Document 3: Japanese Patent Laid-Open No. 10-321393/1998.

Patent Document 4: Japanese Patent Laid-Open No. 4-251576/1992.

Patent Document 5: Japanese Patent Laid-Open No 6-196285/1994.

The conventional discharge lamp ballast apparatuses are configured as described above. Thus, as for the first conventional example, the circuit configuration based on the level-shift circuit can operate the switching devices placed at the negative potential in a DC mode, and select an apply voltage polarity and time for firing the discharge lamp optionally. Accordingly, although it can facilitate firing the discharge lamp stably, it requires a complicated level-shift circuit. In addition, to provide a negative DC power source, it must generate all the output power via a DC/DC converter without adding the DC power of the power source. As a result, it entails the transformer and the switching devices with rating satisfying the output power, which presents a problem of limiting the miniaturization or cost reduction of the discharge lamp apparatus.

As for the second conventional example, the capacitors constituting the bootstrap circuit can maintain the ON state of the switching devices at the higher potential side only during a limited time period during which the capacitor has charged power. Therefore, as at the time of firing, when the ON time of the higher potential side switching devices must be longer than that at the steady-state lighting, it is necessary for the capacitors that operate as the power source to secure the power for a longer time. For example, if firing failure is repeated, the ON time sometimes has to be maintained for one second. Thus, as long as the capacitors with a limited size are used, the polarity of the applied voltage for firing the discharge lamp cannot be fixed for a desired time period (the foregoing one second, for example), which present a problem of making it difficult to fire the discharge lamp stably in any conditions.

In this case, although using capacitors with large capacitance can implement a long ON state, it entails an increase in space and cost for mounting the capacitors with large capacitance unnecessary at the time of steady-state lighting, which is unfavorable for the discharge lamp ballast apparatus for headlamps. In addition, extension of the operation time has correlation with the capacitance of the capacitors, and the selection of the capacitors in the limited space of the ballast apparatus has only narrow freedom (particularly when extending time).

As for the third conventional example, it has potentially the same problems as the second conventional example about the ON time. Thus, it has the same problem in that it is difficult to fire the discharge lamp stably.

As for the fourth conventional example, the high potential power source enables the higher potential side switching devices to maintain the ON state for a longer time, and makes it possible to select the voltage apply duration and the voltage polarity for firing the discharge lamp freely, thereby facilitating firing the discharge lamp stably. However, to enable the higher potential side switching devices to achieve the longer ON time, the fourth conventional example supplies the power to the switching devices on the right and left arms in the same manner. The circuits of the two arms, which operate alternately, have the same potential difference as the power source voltage of the H-bridge-type inverter. Accordingly, the capacitors operating at the low voltage side must be charged via a current limiting series resistor to prevent an overcurrent. This of course increases a loss due to the resistor, but also presents a problem of involving an increase of the space and hindering the miniaturization of the ballast apparatus because the voltage applied to the resistor is high and hence a resistor with a high withstanding voltage or resistors connected in series must be use.

As for the fifth conventional example, although it can construct the DC/AC inverter of the discharge lamp ballast apparatus by using the transformer, the transformer is an electronic component whose characteristics are affected by the size thereof. Accordingly, the transformer necessary for the discharge lamp ballast apparatus requires larger space and higher cost than the semiconductor level-shift circuit used in the first conventional example or the bootstrap circuit using the capacitors of the second conventional example, which implements the space-saving, inexpensive circuit configuration. Thus, the fifth conventional example has a problem of being unfavorable as a circuit configuration for the discharge lamp ballast apparatus for the headlamps.

The present invention is implemented to solve the foregoing problems. Therefore it is an object of the present invention to provide a discharge lamp ballast apparatus capable of achieving the miniaturization and cost reduction to enable application to the headlamps of a vehicle, and capable of lighting the discharge lamp stably.

DISCLOSURE OF THE INVENTION

A discharge lamp ballast apparatus in accordance with the present invention includes: an H-bridge-type inverter which has four switching devices connected in a bridge including two switches consisting of a first switching device and a second switching device disposed on a higher potential side of a first DC power source section, and which converts DC voltage from the first DC power source section to AC voltage and supplies the AC voltage to a discharge lamp; a first bootstrap circuit for maintaining an ON state of the first switching device with voltage charged in a first capacitor that is charged by a second DC power source section; a second bootstrap circuit for maintaining an ON state of the second switching device with voltage charged in a second capacitor that is charged by the second DC power source section; and a charging section for charging one of the first capacitor and the second capacitor in conjunction with the second DC power source section.

As described above, according to the present invention, it is configured in such a manner as to charge the first capacitor of the first bootstrap circuit for maintaining the ON state of the first switching device disposed on the higher potential side, or the second capacitor of the second bootstrap circuit for maintaining the ON state of the second switching device on the higher potential side by means of the another charging section in addition to the second DC power source section. Accordingly, one of the first capacitor and second capacitor which is charged by the charging section is charged sufficiently by both the second DC power source section and the charging section. This makes it possible to maintain the ON state of one of the first switching device and second switching device on the charged capacitor side for a long time. As a result, the apparatus can light the Hg-free bulb stably which has a low firing probability and a high possibility of repeating refiring.

In addition, providing the charging section makes it possible to employ the simple and inexpensive bootstrap circuits for firing the Hg-free bulb with a high possibility of repeating refiring. This enables the miniaturization and cost reduction of the discharge lamp ballast apparatus for the vehicle when applying the Hg-free bulbs to the headlamps.

BEST MODE FOR CARRYING OUT THE INVENTION

The best mode for carrying out the invention will now be described with reference to the accompanying drawings to explain the present invention in more detail.

Embodiment 1

Figure 1:
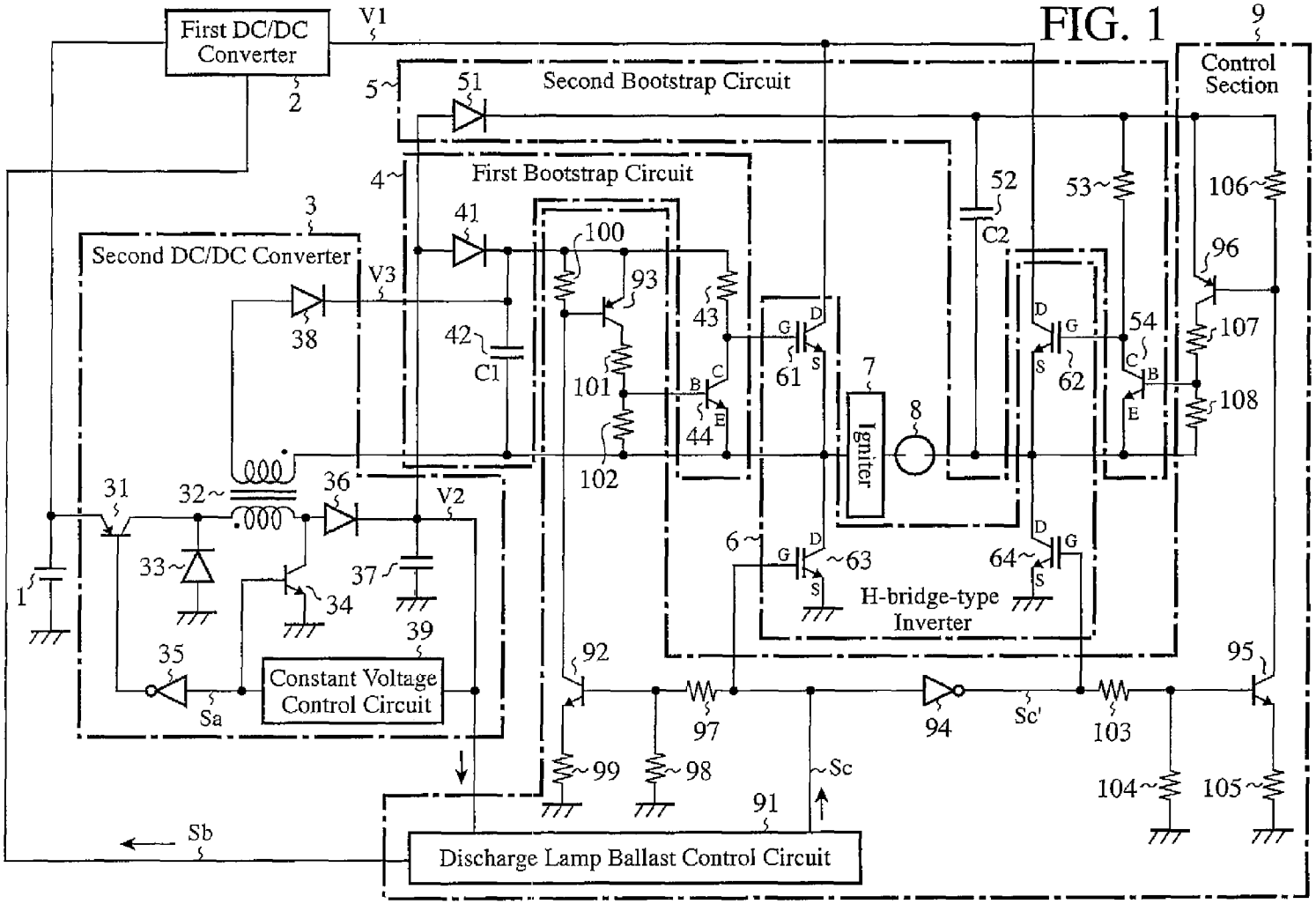
FIG. 1 is a circuit diagram showing a configuration of a discharge lamp ballast apparatus of an embodiment 1 in accordance with the present invention.

FIG. 1 is a circuit diagram showing a configuration of the discharge lamp ballast apparatus of an embodiment 1 in accordance with the present invention.

In FIG. 1, the discharge lamp ballast apparatus is mainly composed of a DC power source 1, a first DC/DC converter 2, a second DC/DC converter 3, a first bootstrap circuit 4, a second bootstrap circuit 5, an H-bridge-type inverter 6, an igniter 7, a discharge lamp 8 and a control section 9.

In the foregoing configuration, the DC power source 1 is a battery mounted on a vehicle, for example.

The first DC/DC converter 2, a first DC power source section, undergoes the switching control by the control section 9, and converts the DC voltage fed from the DC power source 1 to a first DC voltage V1 with a prescribed value.

In the following, the first DC power source section is referred to as the first DC/DC converter 2.

Here, the first DC voltage V1 the first DC/DC converter 2 generates is a plus (positive) potential, and FIG. 1 shows a configuration for lighting using the plus potential. Accordingly, the first DC voltage V1 can be a voltage obtained as a result of adding the voltage of the DC power source 1. This makes it possible to achieve the miniaturization and cost reduction of the components.

The second DC/DC converter 3, a second DC power source section, is a chopper-type switching regulator, and converts the DC voltage fed from the DC power source 1 to a second DC voltage V2 with a prescribed value. As its configuration, it comprises a PNP-type switching transistor 31; a transformer 32 having a primary winding n1 operating as a choke coil and a secondary winding n2 for generating an AC voltage; a diode 33 for forming a current path of the primary winding n1 of the transformer 32 at the time when the transistor 31 is in the switching off state; an NPN-type transistor 34 for switching; an inverting circuit 35 for inverting an input signal so that the transistor 31 and transistor 34 are switched on and off in phase; a rectifier diode 36; a smoothing capacitor 37; a rectifier diode 38; and a constant voltage control circuit 39 for carrying out switching control of the transistor 31 and transistor 34 in such a manner as to convert the DC voltage fed from the DC power source 1 to a second DC voltage V2 with a prescribed value.

The second DC/DC converter 3 is a converter for both stepping up and down the voltage, and converts, even if the voltage of the DC power source 1 has a high or low difference with respect to the standard voltage value, the voltage to a constant second DC voltage V2. For example, in the configuration of FIG. 1, even if the voltage of the DC power source 1 (the voltage of the battery) has a range of 6 V-16 V with respect to the standard voltage value 12 V, the converter converts it to the constant second DC voltage V2 (=8 V). To achieve this, in response to the voltage value of the second DC voltage V2 which is fed back to the input, the constant voltage control circuit 39 generates a switching control signal Sa for making the second DC voltage V2 constant, and carries out the switching control of the transistor 31 and transistor 34 with the control signal Sa. As for the former transistor 31, it carries out the switching control via the inverting circuit 35. The diode 36 rectifies the AC voltage generated across the primary winding n1 of the transformer 32 by the switching control, and the capacitor 37 smoothes it to obtain the constant second DC voltage V2 (8 V).

The second DC/DC converter 3 is configured as both the step-up and step-down converter as described above in order that semiconductor device IGBTs (Insulated Gate Bipolar Transistors) with a high on-gate voltage are used as first switching device 61-fourth switching device 64 constituting the H-bridge-type inverter 6 which will be described later. More specifically, since the on-gate voltage of the TGBTs, which is about 6 V, is higher than the on-gate voltage 4 V of an FET (field-effect transistor), when employing a 12 V battery power source of the vehicle as the DC power source 1 and if the voltage of the battery power source is very low, it sometimes occurs that the IGBTs cannot be turned on via the gate during the operation. Accordingly, to secure the on-gate voltage of the IGBTs even if the voltage of the battery power source is low, the configuration operating as both the step-up and step-down converter is employed.

As for a third DC voltage V3 obtained by rectifying the AC voltage generated at the secondary winding n2 of the transformer 32 by the diode 38, it serves as the power source for supplying a charging current to a capacitor 42 (C1) constituting the first bootstrap circuit 4. The power source constitutes a charging section for charging the capacitor 42 (C1).

The first bootstrap circuit 4 comprises a diode 41 having its anode supplied with the second DC voltage V2; a first capacitor (referred to as "capacitor 42 (C1)" from now on) charged with the second DC voltage V2 via the diode 41; a resistor 43 for supplying the charging voltage of the capacitor 42 (C1) to the gate (G) of the first switching device 61 of the H-bridge-type inverter 6 which will be described later; and an NPN-type transistor 44 turned on and off by the control section 9 which will be described later; and carries out the on-off driving of the first switching device 61.

The capacitor 42 (C1) constituting the first bootstrap circuit 4 is charged with the second DC voltage V2 via the diode 41, and is supplied with the charging current from a power source consisting of the third DC voltage V3 on the secondary winding n2 side of the transformer 32 constituting the charging section as described above.

The second bootstrap circuit 5 comprises a diode 51, a second capacitor (referred to as "capacitor 52 (C2)" from now on), a resistor 53, and an NPN-type transistor 54, which have the same purposes as their counterparts of the first bootstrap circuit 4; and carries out the on-off driving of the switching device 62 of the H-bridge-type inverter 6 which will be described later.

The H-bridge-type inverter 6 includes the first switching device 61 and second switching device 62 disposed on the higher potential side of the first DC voltage V1 the first DC/DC converter 2 generates; and the third switching device 63 and fourth switching device 64 disposed on the lower potential side of the first DC voltage V1, in which the pair of the first switching device 61 and fourth switching device 64 and the pair of the second switching device 62 and third switching device 63 are turned on and off alternately by the control section 9 to convert the first DC voltage V1 to an AC voltage, and the AC voltage is supplied to the discharge lamp 8 which will be described later.

When using a conventional bulb as the discharge lamp 8, FETs can be employed as the first switching device 61-fourth switching device 64. In contrast with this, when using a Hg-free bulb discharge lamp 8, the current flowing during the steady-state lighting is twice that of the conventional bulb, and the current flowing through each of the first switching device 61-fourth switching device 64 is also twice that of the conventional bulb. Accordingly, when using the FETs, which are applied to the discharge lamp 8 consisting of the conventional bulb, for the first switching device 61-fourth switching device 64 in the case of the Hg-free bulb, the loss due to the on-resistance during the operation becomes large. Thus, to suppress the loss when applying the FETs to the Hg-free bulb to the same level as at the time when lighting the conventional bulb, the on-resistance must be reduced to ¼ because a loss due to a resistor is proportional to the square of the current. In this case, the chip area of the FETs increases by a factor of 4 (this entails a cost increase, of course), which is unrealistic.

In view of this, the IGBTs are used for the first switching device 61-fourth switching device 64. In this case, since the loss during the operation becomes linear to the current because of the nearly constant on-voltage, the IGBTs are preferably used for the ballast apparatus for the Hg-free bulb. Incidentally, the IGBT, a device obtained by combining a MOSFET (metal-oxide-semiconductor field-effect transistor) and a bipolar transistor into a single chip, has the characteristics of a MOSFET such as high-speed switching and low driving power and the characteristics of a bipolar transistor such as a low resistance. The on-gate voltage of the IGBT, however, is higher than that of the FET as described above, and requires special consideration to the power source for supplying the gate voltage.

The igniter 7 generates high voltage pulses from the first DC voltage V1 supplied from the first DC/DC converter 2 via the H-bridge-type inverter 6.

The discharge lamp 8 is a high-intensity discharge lamp (HID) such as a Hg-free bulb used as a headlamp of a vehicle. The high voltage pulses the igniter 7 generates are supplied across the electrodes so that the breakdown across the electrodes takes place and the discharge starts. After the firing, the mode of the discharge lamp 8 is moved to the steady-state lighting by the AC voltage supplied from the H-bridge-type inverter 6.

The control section 9 comprises a discharge lamp ballast control circuit 91, an NPN-type transistor 92, a PNP-type transistor 93, an inverting circuit 94, an NPN-type transistor 95, a PNP-type transistor 96, and resistor 97-resistor 108. It carries out the switching control of the first DC/DC converter 2, and controls the lighting of the discharge lamp 8 by switching the pair of the first switching device 61 and fourth switching device 64 and the pair of the second switching device 62 and third switching device 63 of the H-bridge-type inverter 6 in such a manner that the two pairs turn on and off alternately.

The discharge lamp ballast control circuit 91 of the control section 9, which operates using the second DC voltage V2 generated by the second DC/DC converter 3 as the power source, generates the switching control signal Sb for controlling the switching of the first DC/DC converter 2, thereby causing it to output the first DC voltage V1 with the prescribed value.

In addition, the control section 9 has the discharge lamp ballast control circuit 91 generate an on/off setting switching signal Sc for on/off switching of the first switching device 61 to fourth switching device 64 of the H-bridge-type inverter 6, and delivers it to the gates (G) of the first switching device 61 to fourth switching device 64 via the first bootstrap circuit 4, second bootstrap circuit 5 or inverting circuit 94 or directly.

Next, the general basic operation of the configuration of FIG. 1 will be described.

In the basic operation, the description will be omitted (will be described later) about the supply of the charging current from the third DC voltage V3 on the secondary winding n2 side of the transformer 32 to the capacitor 42 (C1) of the first bootstrap circuit 4, and it is assumed that a transition from firing to steady-state lighting of the discharge lamp 8 is performed stably.

The control section 9, as its initial operation, sets by the on/off setting switching signal Sc the pair of the first switching device 61 and fourth switching device 64 of the H-bridge-type inverter 6 at an ON state, and the pair of the second switching device 62 and third switching device 63 at an OFF state. The ON or OFF setting of these switching devices is carried out as follows not only in the initial operation, but also in other operation.

Considering the delivery of the on/off setting switching signal Sc, which is generated by the discharge lamp ballast control circuit 91 of the control circuit 9, to the first bootstrap circuit 4, it is delivered to the base (B) of the transistor 44 via a transistor circuit consisting of the transistor 92 and the resistor 97-resistor 100 and a transistor circuit consisting of the transistor 93 and the resistors 101 and 102; and the output of the collector (C) of the transistor 44 is applied to the gate (G) of the first switching device 61 so that the first switching device 61 undergoes the on/off setting. Likewise, to the second bootstrap circuit 5, the on/off setting switching signal Sc' obtained by inverting the phase of the on/off setting switching signal Sc through the inverting circuit 94 is delivered to the base (B) of the transistor 54 via a transistor circuit consisting of the transistor 95 and the resistor 103-resistor 106 and a transistor circuit consisting of the transistor 96 and the resistors 107 and 108; and the output of the collector (C) of the transistor 54 is applied to the gate (G) of the second switching device 62 so that the second switching device 62 undergoes the on/off setting. To the third switching device 63, the on/off setting switching signal Sc is directly delivered to its gate (G) so that it undergoes the on/off setting. In addition, to the fourth switching device 64, the on/off setting switching signal Sc' passing through the inverting circuit 94 is delivered to its gate (G) so that it undergoes the on/off setting.

At the time of the setting in the initial operation, the first bootstrap circuit 4 operates as follows. More specifically, according to the basic operation of the foregoing bootstrap circuit, when the first switching device 61 disposed at the higher potential side of the first DC voltage V1 is set in the OFF state, and the third switching device 63 which is connected in series with it immediately thereunder on the lower potential side in the bridge connection is set in the ON state, the capacitor 42 (C1) is charged, and the power of the capacitor 42 (C1) which is charged at this time is used as a power source for maintaining the ON state of the first switching device 61 in the next half cycle. The capacitor 42 (C1) is charged with the second DC voltage V2 via the diode 41 (although additional charge due to the third DC voltage V3 is also present in practice, it is excluded here because of the foregoing assumption).

At the timing the capacitor 42 (C1) is charged, the control section 9 inverts the polarity of the on/off setting switching signal Sc so as to set the pair of the first switching device 61 and fourth switching device 64 of the H-bridge-type inverter 6 at the ON state, and to set the pair of the second switching device 62 and third switching device 63 at the OFF state. By this setting, the voltage charged in the capacitor 42 (C1) of the first bootstrap circuit 4 is applied to the gate (G) of the first switching device 61 via the resistor 43 so that the ON state of the first switching device 61 is maintained. The ON state of the first switching device 61 and the fourth switching device 64 enables the first DC voltage V1 to be applied to the igniter 7, and the igniter 7 generates the high voltage pulse from the first DC voltage V1 applied thereto. The high voltage pulse is applied across the electrodes of the discharge lamp 8 so that the breakdown occurs between the electrodes, thereby starting the discharge (lighting) of the discharge lamp 8.

In addition, in the same manner as described above, when the second switching device 62 disposed at the higher potential side of the first DC voltage V1 is set in the OFF state, and the fourth switching device 64 which is connected in series with it immediately thereunder on the lower potential side in the bridge connection is set in the ON state, the capacitor 52 (C2) of the second bootstrap circuit 5 is charged in the same manner as the capacitor 42 (C1) of the first bootstrap circuit 4, and the power thereof is used as a power source for maintaining the ON state of the second switching device 62 in the next half cycle.

At the timing the capacitor 52 (C2) is charged, the control section 9 returns the polarity of the on/off setting switching signal Sc so as to set the pair of the first switching device 61 and fourth switching device 64 at the OFF state, and to set the pair of the second switching device 62 and third switching device 63 at the ON state. By this setting, the voltage charged in the capacitor 52 (C2) of the second bootstrap circuit 4 is applied to the gate (G) of the second switching device 62 via the resistor 53 so that the ON state of the second switching device 62 is maintained. The ON state of the second switching device 62 and the third switching device 63 enables the first DC voltage V1 to be applied to the discharge lamp 8 via the igniter 7. The direction of the current flowing through the discharge lamp 8 owing to the apply voltage is opposite to the direction of the current when the pair of the first switching device 61 and fourth switching device 64 is set at the ON state.

In addition, when the first switching device 61 is set in the OFF state and the third switching device 63 is set in the ON state, the capacitor 42 (C1) of the first bootstrap circuit 4 is charged as described before.

At the timing the capacitor 42 (C1) is charged, the control section 9 inverts the polarity of the on/off setting switching signal Sc so as to set the pair of the first switching device 61 and fourth switching device 64 at the ON state, and the pair of the second switching device 62 and third switching device 63 at the OFF state. By the charged voltage of the capacitor 42 (C1) at this setting, the ON state of the first switching device 61 is maintained so that the ON state of the first switching device 61 and the fourth switching device 64 enables the first DC voltage V1 to be applied to the discharge lamp 8 via the igniter 7. The direction of the current flowing through the discharge lamp 8 owing to the apply voltage is opposite to the direction of the current when the pair of the second switching device 62 and third switching device 63 is set at the ON state.

After the breakdown of the discharge lamp 8, followed by the discharge (lighting) as described above, the pair of the first switching device 61 and fourth switching device 64 and the pair of the second switching device 62 and third switching device 63 turns on and off alternately so that the first DC voltage V1 is converted to the AC voltage, and the AC voltage is supplied to the discharge lamp 8. Thus, the discharge lamp 8 makes a transition to the AC lighting which is the steady-state lighting (arc discharge).

Next, referring to FIG. 2 and FIG. 1, the purpose and operation of supplying the capacitor 42 (C1) of the first bootstrap circuit 4 with the charging current owing to the third DC voltage V3 on the secondary winding n2 side of the transformer 32 will be described.

Figure 2:
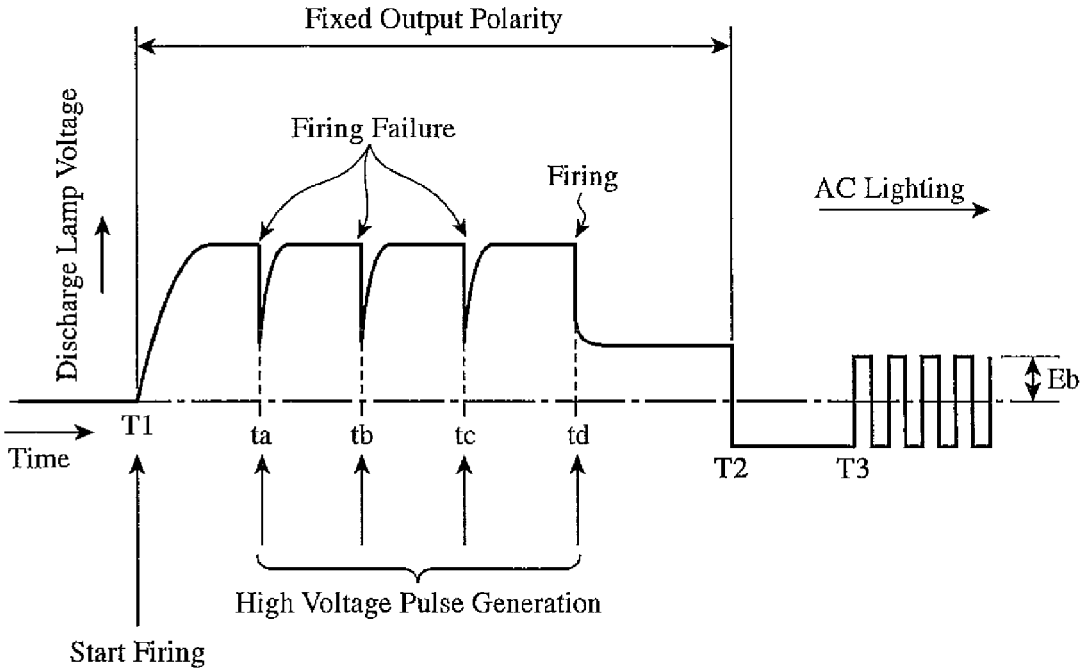
FIG. 2 is a diagram illustrating firing process of the discharge lamp.

FIG. 2 is a diagram explaining the lighting process of the discharge lamp 8.

In FIG. 2, the timing T1 designates the boosting start timing of the first DC/DC converter 2, and the period from the timing T1 to T2 is a term of firing the discharge lamp 8. The timing T2 and forward designates a transition to the AC lighting which is the steady-state lighting (arc discharge). After nearly a fixed time period has elapsed from the timing T2, the AC lighting is started. The frequency during the AC lighting is about 400 Hz, for example, and the discharge lamp voltage Eb is about 42 V in the case of a Hg-free bulb, and about 85 V in the case of a conventional bulb, for example.

As was described in the foregoing basic operation, the discharge lamp 8 makes a transition to the steady-state lighting after the firing process.

In the real firing of the discharge lamp 8, the discharge lamp 8 does not always induces the breakdown immediately by the high voltage pulse the igniter 7 generates, or even if it brings about the breakdown, it does not always make a transition to the stable steady-state lighting (arc discharge) immediately after that, thus resulting in a firing failure sometimes. In this case, it is necessary for the igniter 7 to generate the high voltage pulse again, to refire the discharge lamp 8 by repeating the breakdown.

FIG. 2 shows an example of repeating a firing failure three times during the timing T1 to T2, and of succeeding in firing on the fourth time, thereby making a transition to the AC lighting which is the steady-state lighting. At each timing ta-td, the igniter 7 generates a high voltage pulse, trying to refire by repeating the breakdown of discharge lamp 8. At timing ta-tc, the firing fails, and at timing td, the firing succeeds, making a transition to the steady-state lighting.

In particular, the Hg-free bulb has a larger thermal capacity than the conventional bulb as described before, and because of an increase of the thermal capacity, the probability of not making a transition to the stable steady-state lighting is higher even if the breakdown occurs. Thus, the possibility of repeating the refiring is higher than in the case of the conventional bulb.

In addition, as shown in the period from timing T1 to T2 in FIG. 2, it is necessary for the H-bridge-type inverter 6 for converting DC to AC to fix the polarity of the voltage to be applied to the discharge lamp 8 to the one-side polarity closer to the DC output operation (positive (+) side in FIG. 2) without switching during the period from before the occurrence of the inter-electrode breakdown of the discharge lamp 8 owing to the high voltage pulse the igniter 7 generates to the breakdown and up to the start of the stable steady-state lighting (arc discharge). Accordingly, the repetition of the refiring in the lighting operation forces the H-bridge-type inverter 6 to continue the output fixed to the one-side polarity for a long time.

To cause the H-bridge-type inverter 6 to maintain the output fixed to the one-side polarity for the long time, the first bootstrap circuit 4 of FIG. 1 must maintain the ON state of the first switching device 61 of the H-bridge-type inverter 6 for the longtime. To achieve this, the power charged in the capacitor 42 (C1) for maintaining the ON state must survive during the ON state. However, since the size of the capacitor 42 (C1) is limited, charging with only the second DC voltage V2 via the diode 41 is not enough for the charged power so that it becomes difficult to maintain the ON state of the first switching device 61 for a long time.

Accordingly, as shown in FIG. 1, the capacitor 42 (C1) is not only charged with the second DC voltage V2 via the diode 41, hut also supplied with a charging current from another power source, that is, the third DC voltage V3 on the secondary winding n2 side of the transformer 32. Thus, the capacitor 42 (C1) is charged sufficiently with both the second DC voltage V2 via the diode 41 and the third DC voltage V3 from the secondary winding n2 side of the transformer 32, thereby being able to maintain the ON state of the first switching device 61 for a long time. This makes it possible to cope with the Hg-tree bulb having a high probability of repeating the refiring because of the low firing probability (bad starting characteristics) as described before.

In addition, as shown in FIG. 1, such a configuration is employed in which the third DC voltage V3 on the secondary winding n2 side of the transformer 32 supplies the charging current only to the capacitor 42 (C1) of the first bootstrap circuit 4 for maintaining the ON state of the first switching device 61, but not to the capacitor 52 (C2) of the second bootstrap circuit 5 for maintaining the ON state of the second switching device 62.

In contrast with this, the bootstrap circuit in the fourth conventional example supplies a power source to both the right and left higher potential side switching devices to enable them to perform a DC-mode long time operation. However, as the fifth conventional example realizes with the configuration using the transformer, the discharge lamp ballast apparatus requires the long time polarity fixation only for the time period from the inter-electrode breakdown by the applied high voltage pulse to the stabilization of the current of the discharge lamp 8, and it is not necessary to maintain the equivalent DC-mode ON state for a long time as to the opposite polarity in the H-bridge-type inverter 6. Accordingly, it is enough to turn on in a DC mode one of the first switching device 61 and the second switching device 62 disposed on the higher potential side. Thus, as shown in FIG. 1, the configuration is employed in which the third DC voltage V3 on the secondary winding n2 side of the transformer 32 supplies the charging current to only the capacitor 42 (C1) of the first bootstrap circuit 4 for maintaining the ON state of the first switching device 61.

Furthermore, the circuit on the secondary winding n2 side of the transformer 32 for supplying the charging current to the capacitor 42 (C1) makes use of the second DC/DC converter 3 that is necessary originally.

More specifically, the second DC/DC converter 3 is originally required as the power source for setting the gate (G) voltage of the first switching device 61 and second switching device 62 via the diodes 41 and 51, respectively, and for the discharge lamp ballast control circuit 91. As the configuration of the power source, the configuration using a choke coil in the primary winding n1 portion in FIG. 1 is sufficient.

The second DC/DC converter 3, however, utilizes such a configuration that adds a winding (single winding, for example) to the choke coil as the secondary winding n2, thereby constructing the transformer 32 having the primary winding n1 functioning as the choke coil and the secondary winding n2 for generating the AC voltage. The primary winding n1 and the secondary winding n2 are isolated from each other so that the secondary winding n2 side serves as an insulated power source.

This makes it possible to implement the power source for supplying the charging current to the capacitor 42 (C1) with a small number of components, and to maintain the ON state of the first switching device 61 disposed on the higher potential side for a long time.

In addition, as for the current for maintaining the ON state of the first switching device 61 with the capacitor 42 (C1) of the first bootstrap circuit 4, since it is only the internal current of the driver for driving the first switching device 61, securing only a very small amount of current is sufficient. Accordingly, it is enough for the second DC/DC converter 3, which has the configuration including the transformer 32 having the additional secondary winding n2, to use a simple winding as the secondary winding n2 of the transformer 32.

Although the second DC/DC converter 3 is a converter that possesses both the stepping up and down functions of the voltage in the assumption that the standard voltage of the DC power source 1 is 12 V, this is not essential. For example, when the standard voltage of the DC power source 1 is high such as 24 V, the second DC/DC converter 3 can be a step-down DC/DC converter.

In addition, although the foregoing description is made by way of example that supplies the charging current to the capacitor 42 (C1) of the first bootstrap circuit 4 from the secondary winding n2 side of the transformer 32, this is not essential. For example, instead of the configuration, a configuration that supplies the charging current to the capacitor 52 (C2) of the second bootstrap circuit 5 from the secondary winding n2 side of the transformer 32 can also be employed. As for the configuration, the polarity of the voltage applied from the H-bridge-type inverter 6 to the discharge lamp 8 during the period from timing T1 to T2 in FIG. 2 becomes negative (−) side.

As described above, the present embodiment 1 is configured in such a manner as to charge the capacitor 42 (C1), which is provided in the first bootstrap circuit 4 for maintaining the ON state of the first switching device 61 serving as one of the two switching devices disposed on the higher potential side of the first DC voltage V1, not only with the second DC voltage V2, but also with the third DC voltage V3 on the secondary winding n2 side of the transformer 22. Accordingly, the capacitor 42 (C1) is sufficiently charged with the second DC voltage V2 and the third DC voltage V3, and hence can maintain the ON state of the first switching device 61 for a long time. This makes it possible to prevent the polarity of the voltage applied to the discharge lamp 8 from being switched, and to fix the polarity to one-side closer to the DC output operation, thereby being able to light the Hg-free bulb having a high possibility of repeating refiring because of the low firing probability (bad starting characteristics).

In addition, although FIG. 1 shows a configuration that charges the capacitor 42 (C1) of the first bootstrap circuit 4 with the third DC voltage V3 on the secondary winding n2 side of the transformer 32, this is not essential. For example, instead of the configuration, a configuration is also possible which charges the capacitor 52 (C2) of the second bootstrap circuit 5 with the third DC voltage V3. In the case of the configuration, the foregoing advantages are also obtained. In addition, the polarity of the applied voltage for firing the discharge lamp 8 can be selected freely with enabling a necessary and sufficient DC-mode operation, thereby being able to increase the design flexibility of the discharge lamp ballast apparatus.

Furthermore, the configuration charges only one (side) of the capacitor 42 (C1) for maintaining the ON state of the first switching device 61 and the capacitor 52 (C2) for maintaining the ON state of the second switching device 62, which are disposed on the higher potential side, with both the second DC voltage V2 and third DC voltage V3. Accordingly, as compared with the fourth conventional example that enables both the right and left higher potential side switching devices to carry out the DC-mode operation for a long time, the present embodiment 1 can reduce the functions, and simplify the configuration of the discharge lamp ballast apparatus, thereby being able to miniaturize the apparatus.

In addition, by providing the circuit for charging with the third DC voltage V3, the simple and inexpensive first and second bootstrap circuits 4 and 5 can be used for firing the Hg-free bulb with a high possibility of repeating the refiring. This enables the miniaturization and cost reduction of the discharge lamp ballast apparatus for the vehicle when applying the Hg-free bulbs to the headlamps.

Moreover, since the second DC/DC converter 3 for generating the third DC voltage V3 employs the insulated-type transformer 32 that uses a winding operating as a choke coil as the primary winding n1 and adds the simple secondary winding n2 to the primary winding n1, it can implement the power source for charging the capacitor 42 (C1) (or capacitor 52 (C2)) with a small number of components. Besides, since the primary winding n1 is insulated from the secondary winding n2 and hence the third DC voltage V3 becomes an insulated power source, the third DC voltage V3 can perform the charging without interference with the second DC voltage V2.

In addition, the first switching device 61 to the fourth switching device 64 of the H-bridge-type inverter 6 are each composed of an FET or IGBT. Thus, it is possible to select the IGBTs when employing as the discharge lamp 8 the Hg-free bulb whose current flowing during the steady-state lighting is twice that of the conventional bulb, and the FETs when employing the conventional bulb. This makes it possible to construct a reasonable discharge lamp ballast apparatus.

Next, a second embodiment in accordance with the present invention will be described.

Embodiment 2

Figure 3:
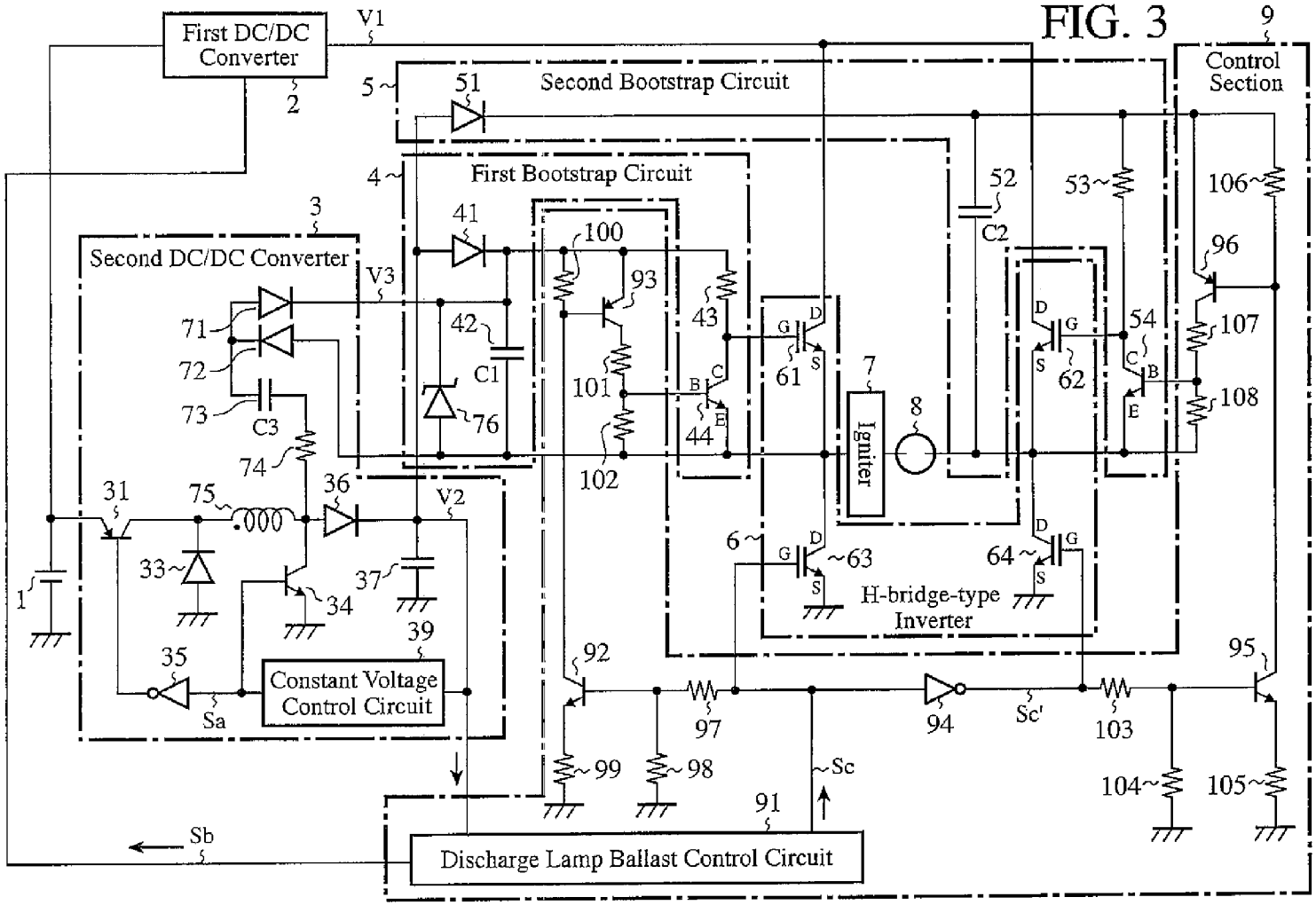
FIG. 3 is a circuit diagram showing a configuration of the discharge lamp ballast apparatus of an embodiment 2 in accordance with the present invention.

FIG. 3 is a circuit diagram showing a configuration of a discharge lamp ballast apparatus of the embodiment 2 in accordance with the present invention.

In FIG. 3, the circuit for generating the third DC voltage V3 differs from that of the embodiment 1 in that the transformer (32) used in the embodiment 1 is replaced by a choke coil (75), and that diodes (71) and (72) and a capacitor C3 (73) are employed to configure a charge pump. Since the remaining configuration is the same, the description thereof is omitted here.

As described in the embodiment 1, the second DC/DC converter 3 is a chopper-type switching regulator, and an approximately square wave whose amplitude corresponds to the second DC voltage V2 is generated at the point of connection between the choke coil (75) and the transistor (34). When the point of connection is at an "L level", the capacitor 73 (C3) is charged with the voltage corresponding to the output voltage of the H bridge. When the point of connection is at an "H level", the voltage corresponding to the second DC voltage V2 is added to the voltage corresponding to the output voltage of the H bridge. Thus, the charge pump for generating the addition result as the third DC voltage V3 is formed.

As described above, although the third DC voltage V3 becomes uninsulated in the present embodiment 2, a miniaturized, inexpensive discharge lamp ballast apparatus having equivalent characteristics in the rest can be configured.

INDUSTRIAL APPLICABILITY

As described above, the discharge lamp ballast apparatus in accordance with the present invention provides, in addition to the second DC power source section, another charging section for charging the capacitor to one of the two capacitors. Thus, it enables stable lighting, miniaturization and cost reduction of the apparatus by using simple and inexpensive bootstrap circuits. Accordingly, it is suitable for applying to the discharge lamp ballast apparatus for vehicles employing Hg-free bulbs having a low firing probability and a high possibility of repeating refiring as the headlamps.

What is claimed is:

1. A discharge lamp ballast apparatus comprising:

an H-bridge-type inverter which has four switching devices connected in a bridge including two switches consisting of a first switching device and a second switching device disposed on a higher potential side of a first DC power source section, and which converts DC voltage from said first DC power source section to AC voltage and supplies the AC voltage to a discharge lamp;

a first bootstrap circuit for maintaining an ON state of said first switching device with voltage charged in a first capacitor that is charged by a second DC power source section;

a second bootstrap circuit for maintaining an ON state of said second switching device with voltage charged in a second capacitor that is charged by said second DC power source section; and a charging section for charging one of the first capacitor and the second capacitor in conjunction with said second DC power source section.

2. The discharge lamp ballast apparatus according to claim 1, wherein said second DC power source section comprises an insulating-type transformer having a primary winding operating as a choke coil and a secondary winding added to the primary winding; and said charging section charges one of the first capacitor and the second capacitor with voltage obtained by converting AC voltage generated across the secondary winding of said transformer to DC voltage.

3. The discharge lamp ballast apparatus according to claim 1, comprising a charge pump that is configured using approximately square voltage generated in said second DC power source section, wherein one of the first capacitor and the second capacitor is charged with voltage undergoing level shifting by a capacitor of said charge pump.

4. The discharge lamp ballast apparatus according to claim 1, wherein each of the four switching devices of said H-bridge-type inverter consists of an FET (field-effect transistor) or an IGBT.

* * * * *